United States Patent [19]

Means

[11] 3,987,292

[45] Oct. 19, 1976

[54] DISCRETE FOURIER TRANSFORM VIA CROSS CORRELATION CHARGE TRANSFER DEVICE

[75] Inventor: Robert W. Means, San Diego, Calif.

[73] Assignee: The United States of America as represented by the Secretary of the Navy, Washington, D.C.

[22] Filed: June 2, 1975

[21] Appl. No.: 583,086

[52] U.S. Cl. ..... 235/181; 235/150.53; 235/193; 307/221 D; 357/24

[51] Int. Cl.[2] ..... G06G 7/19

[58] Field of Search ..... 235/181, 193, 150.53, 235/152, 156; 307/221 C, 221 D; 357/24

[56] References Cited

UNITED STATES PATENTS

| | | | |
|---|---|---|---|
| 3,449,553 | 6/1969 | Swan | 235/181 |
| 3,474,260 | 10/1969 | Frohbach | 307/221 D |
| 3,598,979 | 8/1971 | Moreau | 235/181 |
| 3,643,106 | 2/1972 | Berwin et al. | 307/221 C |
| 3,670,151 | 6/1972 | Lindsay et al. | 235/181 |
| 3,704,826 | 12/1972 | Constantin | 235/156 |
| 3,831,013 | 8/1974 | Alsup et al. | 235/181 |
| 3,903,406 | 9/1975 | London | 235/181 |

OTHER PUBLICATIONS

Tiemann et al: Charge Transfer Devices Filter Complex Communications Signals, Electronics, Nov. 14, 1974, pp. 113–116.

*Primary Examiner*—Felix D. Gruber
*Attorney, Agent, or Firm*—Richard S. Sciascia; Ervin F. Johnston; William T. Skeer

[57] ABSTRACT

A circuit for generating a discrete Fourier transform in real time employs a digital and analog shift register, each cell of which is tapped to feed an analog switch. The outputs of the individual analog switches are fed to a summing bus where the switched analog signals combine to form the desired Fourier transform.

4 Claims, 1 Drawing Figure

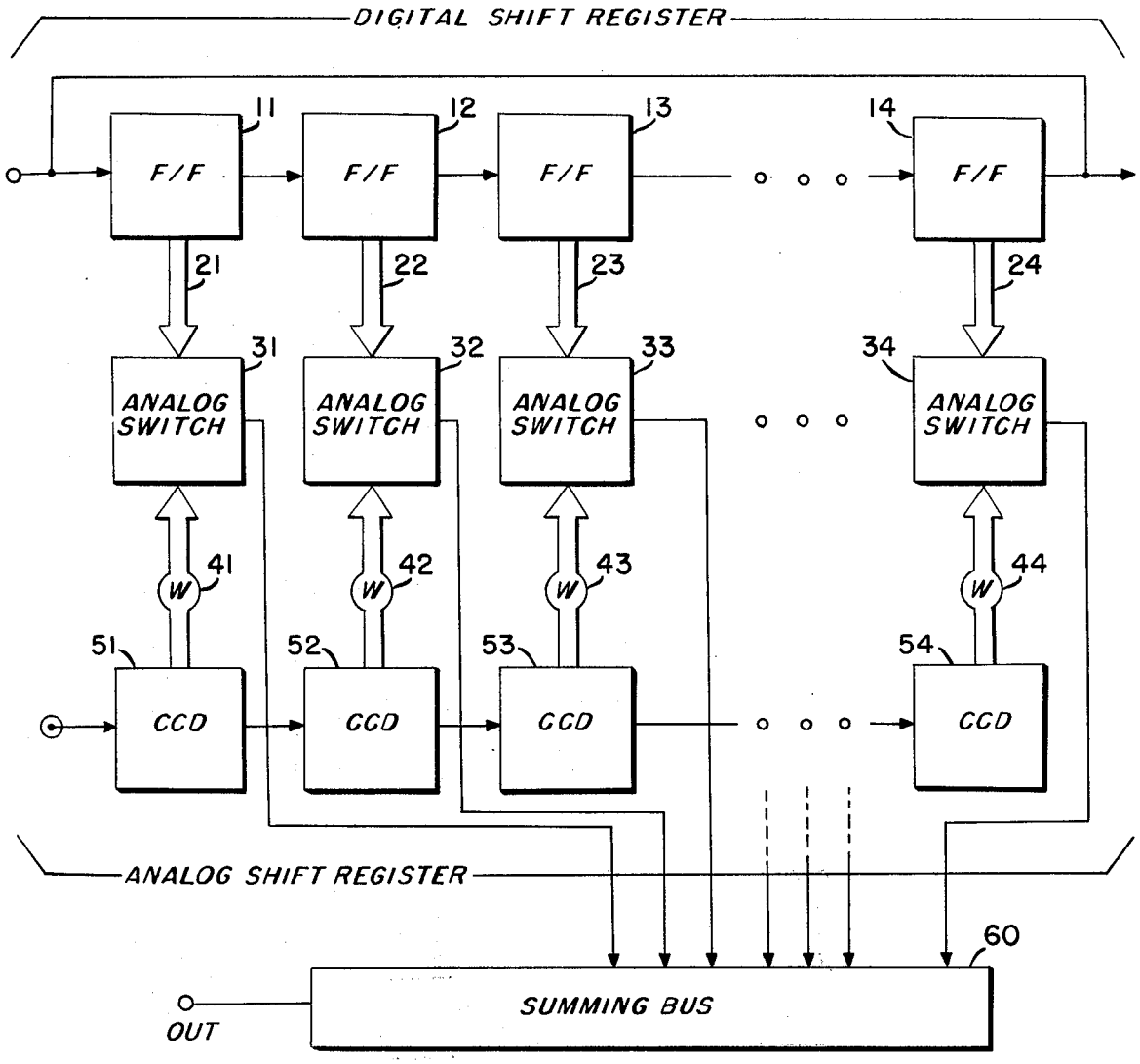
DIGITAL SHIFT REGISTER
F/F
F/F
F/F
F/F
11
12
13
14
21
22
23
24
ANALOG SWITCH
ANALOG SWITCH
ANALOG SWITCH
ANALOG SWITCH
31
32
33
34
W
W
W
W
41
42
43
44
CCD
CCD
CCD
CCD
51
52
53
54
ANALOG SHIFT REGISTER
SUMMING BUS
60
OUT

DISCRETE FOURIER TRANSFORM VIA CROSS CORRELATION CHARGE TRANSFER DEVICE

STATEMENT OF GOVERNMENT INTEREST

The invention described herein may be manufactured and used by or for the Government of the United States of America for governmental purposes without the payment of any royalties thereon or therefor.

FIELD OF THE INVENTION

The invention pertains to the field of solid state electronics. In greater particularity, this invention pertains to the field of computer science. By way of further characterization, this invention pertains to an electrical circuit for providing a discrete Fourier transform. By way of further characterization and illustration, this invention pertains to a low power, lightweight circuit implementation for providing a real time Fourier transform signal. By way of further characterization, this invention provides a discrete Fourier transform generating circuit employing charge coupled devices.

DESCRIPTION OF THE PRIOR ART

Discrete Fourier transforms having long been used in mathematical computations in a wide variety of computational endeavors. These Fourier transforms used in the prior art are now generated by general purpose digital computers. These machines are relatively slow and, thus, prevent real time application of the Fourier transform. Further, the general purpose digital computers are heavy and consume a considerable amount of power and thus are unsuited for instrument packages and other applications where power and space are at a premium, such as oceanographic instrument packages.

SUMMARY OF THE INVENTION

This invention overcomes the prior art problems, particularly those problems having to do with the ability of processing signals in real time and the size and power consumption of the computer circuitry required to perform these mathematical operations. This advance in the art is obtained by using a digital shift register which, according to conventional practice, includes a plurality of monostable multivibrators which are serially connected and have a recirculating feedback loop. Each cell or switching unit of the digital shift register is used to trigger an analog switch. An analog shift register, which may be comprised of a charge coupled device (CCD) channel, parallels the digital shift register channel and each cell is similarly connected to the analog switch for control switching thereby. Unlike the digital shift register taps, the analog shift register taps are weighted such that the output corresponds to a predetermined analog expression. The output of each analog switch is connected to a summing bus where the switched analog signals are combined resulting in the composite desired Fourier transform signal.

OBJECTS OF THE INVENTION

It is accordingly an object of this invention to provide an improved computer circuit.

A further object of this invention is to provide an electrical circuit for generating a Fourier transform.

Another object of this invention is the provision of a electrical circuit for generating a Fourier transform, of an analog signal in real time.

Still another object of this invention is the provision of a low cost and low power consumption circuit for the generation of a real time Fourier transform of an analog signal.

These and other objects of the invention will become more readily apparent from the ensuing description when taken together with the drawings.

BRIEF DESCRIPTION OF THE DRAWING

The drawing illustrates in diagrammatic form the circuit comprising the invention.

DESCRIPTION OF THE PREFERRED EMBODIMENT

Referring to the figure, a digital shift register is composed of a plurality of monostable multivibrators or flip flops indicated at 11, 12, 13, and 14. As shown, a recirculating connection is made to couple the output of the last flip flop 14 back to the input of multivibrator 11. Each of the serially connected flip flop circuits receives its signal from the preceding one and it transmits to the following one in well understood fashion resulting in establishment of the digital shift register. The precise number of stages in the shift register is determined by the number of data points used in generation of the Fourier transform, as will be presently described.

Each stage, or cell, of the digital shift register is connected to an associated analog switch. This connection is indicated in the figure by a hollow arrow shown at 21, 22, 23, and 24. The analog switch associated with each cell of the digital shift register is illustrated at 31, 32, 33, and 34. A parallel analog shift register has a plurality of cells equal in number to the cells comprising the digital shift register and are illustrated at 51, 52, 53, and 54. Each of the analog shift register cells has a weighted tap indicated at 41, 42, 43, and 44, which connect the output of each cell of analog shift register to the analog switch associated therewith for selective switching control to the summing bus 60. That is, the switch output of each of the analog switches comprise the weighted tap input from the associated analog switch register cell to produce a composite sum signal which, as will be explained, is a Fourier transform of the associated analog input.

Each cell in the analog shift register, that is 51 through 54, could comprise an individual element of a charge coupled device of the type described in applicant's co-pending application Ser. No. 440,215 filed Feb. 6, 1974, entitled "Analog to Digital Conversion by Charge Transfer Device", and now U.S. Pat. No. 3,930,255. For a more complete description of the operation of charge coupled devices reference is made to this patent which is incorporated herein by reference.

MODE OF OPERATION

Discrete Fourier transform is defined for a finite data set ($g_n$) of N points $$G_k \equiv \sum_{n=o}^{N-1} e^{-2\pi i kn/N} g_n \qquad (1)$$

where; $0 \leq k \leq N-1$.

The substitution $$4kn = (k+n)^2 - (k-n)^2 \qquad (2)$$

results in the expression;

$$G_k = \sum_{n=o}^{N-1} e^{-i\pi (k+n)^2/2N} e^{i\pi (k-n)^2/2N} g_n \qquad (3)$$

where: $o \leq k \leq N-1$.

This expression, the sum of the product of three terms, leads by successive circuitry simplifications to the hardware architecture described above.

Of course, other circuit implementations of the present invention could be made without substantial departure from the inventive concept. For example, the digital shift register could be replaced by another analog shift register and analog switches could be replaced by analog multipliers. This arrangement could be developed using a greater number of charge coupled device structures which would result in a more complex chip but, due to the fewer D-to-A and A-to-D required, would reduce the overall number of chips needed to accomplish the discrete Fourier transform.

The signal to be Fourier transformed is input into the analog shift register. The device has 2N−1 cells which are symmetric about the center tap. The tap weights are derived from equation (3) to be $$e^{+i\pi k^2/2N}$$

Since complex arithmetic is needed, a parallel arithmetic structure must be used. The reference function input into the recirculating digital shift register is derived from equation (3) to be $$e^{-i\pi k^2/2N}$$

since this signal is digitized a parallelism is required for each bit of accuracy needed.

The clock rate of the recirculating digital shift register is twice the clock rate of analog shift register to provide for implementing the above mathematical expressions.

The invention permits a very low power consumption and lightweight device to be fabricated using modern solid state electronic circuitry techniques which result in a highly useful advance in the computational circuitry arts.

The foregoing description taken together with the appended claims constitutes a disclosure such as to enable a person skilled in the electronic and computational arts and having the benefit of the teachings contained therein to make and use the invention. Further, the structure herein described meets the aforestated objects of invention and generally constitutes a meritorious advance in the art unobvious to such a worker not having the benefit of these teachings.

Obviously, many modifications and variations are possible in the light of the above teachings, and, it is therefore understood that the invention may be practiced otherwise than as specifically described.

What is claimed is:

1. A signal processor to produce a Fourier transform of an analog signal having a plurality of data points comprising:

digital shift register means having a plurality of cells for recirculating a digital clocking signal;

a charge coupled device configured as an analog shift register means having a plurality of cells for receipt and circulation of an analog signal at a predetermined rate different from that of said digital shift register;

a plurality of analog switch circuits each connected to a cell of said digital shift register by means of a direct, unweighted tap and connected to a corresponding cell of said analog shift register by means of a weighted tap which is weighted according to the expression;

$$e^{i\pi k^2/2N}$$

where;

$k$ = integers between 0 and (N−1), and $N$ = one-half the number of cells in said analog shift registers plus one; and summing means connected to each of said plurality of analog switches for receipt of the switched outputs therefrom, whereby a composite Fourier transform of the analog signal received by said analog shift register means is obtained.

2. A signal generator according to claim 1 in which the signal transfer rate of the said analog shift register is one half that of said digital shift register.

3. A signal processor circuit according to claim 1 in which said digital shift register means, said analog shift register means and said plurality of analog switch circuits have a number of cells and individual circuits, respectively, equal to one less than twice the number of the data points of the desired Fourier transform.

4. A signal processor according to claim 3 in which the signal transfer rate of the aforesaid analog shift register is one half that of the aforesaid digital shift register.

* * * * *